United States Patent [19]

Hall et al.

[11] 4,389,013

[45] Jun. 21, 1983

[54] CONTAINER HAVING A SELF-LOCKING LID

[75] Inventors: Richard A. Hall, Danville; James R. Sorensen, San Bruno, both of Calif.

[73] Assignee: Georgia-Pacific Corporation, Atlanta, Ga.

[21] Appl. No.: 296,531

[22] Filed: Aug. 26, 1981 (Under 37 CFR 1.47)

[51] Int. Cl.[3] ..... B65D 45/00; B65D 5/66

[52] U.S. Cl. ..... 229/45 R; 229/44 R; 206/509

[58] Field of Search ..... 229/45 R, 44 R, DIG. 11; 206/503, 508, 509

[56] References Cited

U.S. PATENT DOCUMENTS

| | | | |
|---|---|---|---|
| 2,633,285 | 3/1953 | Keller . | |
| 2,736,487 | 2/1956 | George . | |
| 3,010,638 | 11/1961 | Forrer | 229/45 R |
| 3,623,650 | 11/1971 | Watts . | |
| 3,713,579 | 1/1973 | Chaffers . | |
| 3,921,896 | 11/1975 | Ishimura . | |
| 4,187,977 | 2/1980 | Boykin . | |
| 4,245,773 | 1/1981 | Stollberg | 229/DIG. 11 |
| 4,277,015 | 7/1981 | Crane . | |
| 4,291,830 | 9/1981 | Sorensen . | |

*Primary Examiner*—Herbert F. Ross

*Attorney, Agent, or Firm*—Schuyler, Banner, Birch, McKie & Beckett

[57] ABSTRACT

A container suitable for fruit and vegetable produce has a lid with a multipoint friction lock for retaining the lid closed on the container body provided by a stacking tab projecting from the perimeter of the body opening having undercut side edges and an aperture facing toward such opening while the lid has a notch located for the stacking tab to engage therein when the lid is closed, the ends of such notch being spaced to engage beneath the undercut side edges of the stacking tab and the notch providing a locking portion intermediate such notch ends to engage in the stacking tab aperture in the closed position of the lid. Preferably, the material of the lid is diagonally scored to facilitate bending the lid for interengagement of the stacking tab and notch, and to accommodate moderate overfilling of the container.

5 Claims, 6 Drawing Figures

CONTAINER HAVING A SELF-LOCKING LID

BACKGROUND OF THE INVENTION

The invention relates to the art of containers having closable lids and, more particularly, to such containers wherein the cover or lid is reclosable and may be locked in a closed position preferably by its own interaction with the configuration of the container body so that the lid is self-locking without the use of staples, glue, tape or separate tools.

The prior art has suggested many container constructions suitable for handling produce such as fruits and vegetables. This type produce is often shipped in paperboard cartons having reclosable lids. Rushing U.S. Pat. No. 2,551,814 discloses one type of carton used for such produce shipping which contemplates a separate container body with a slip cover. Chaffers U.S. Pat. No. 3,713,579 discloses another type of produce container having a lockable lid which is hinged to the body of the container. The container of this latter patent is stackable by its being provided with upstanding stacking tabs projecting above the perimeter of the opening defined by the container body. These stacking tabs cooperate with stacking recesses formed in the container bottom which serve to receive the stacking tabs of the subjacent container. Further in this Chaffers patent, a locking mechanism for the lid of the container is incorporated in the stacking tab where the end edge of the lid cooperates therewith.

George U.S. Pat. No. 2,736,487 and Crane U.S. Pat. No. 4,277,015 may also be identified from the prior art as teaching various cover locking means usable on containers that are suitable for shipping produce and the like.

Specifically, in the packing and shipping of produce such as fresh table grapes, the use of wooden boxes has been historically adhered to. With there increased volume of use, the cost of using wooden boxes has increased greatly and consequently the agricultural industry has increasingly turned to the use of corrugated box structures as a replacement for wood. Problems that have been encountered with respect to utilizing corrugated boxes include difficulties in produce packing and in field closure of the top flaps of boxes constructed of corrugated paperboard. Further, achieving secure cover locking for the container lid which will withstand rough handling during transport and shipment of the produce without the lid breaking open is an ever present problem.

Prior art solutions to the above problems such as typically identified in the patents mentioned above have not been totally successful. Thus, the invention herein has been developed.

SUMMARY OF THE INVENTION

It is therefore a principal object of the present invention to provide a container suitable for packing and shipping table grapes and the like which is characterized by its ease for loading the produce into the container followed by self-locking of the top lid flaps in closed position relative to the container body.

It is a further object of the present invention to provide a container particularly suitable for packing and shipping table grapes and the like which is readily adapted for ease of closing the top lid flaps in the field without requiring the use of staples, glue, tape or auxiliary equipment.

Another object of the invention is the provision of a container having a self-locking lid that is particularly constructed to facilitate bending the lid for engagement of the locking device for the lid and to accommodate moderate overfilling of the container by reason of the lid construction.

A further object of the invention is to provide a container having a self locking lid which is repeatedly reclosable and lockable without appreciable loss of locking capability.

Also, an object of the invention is to provide a container with a self-locking lid that is stackable with other similar containers wherein the multipoint friction lock for the lid does not rely upon the stacking structure for secure locking of the lid and wherein the lid locking is assisted by the container stacking operation.

These and other objects of the invention are accomplished by providing a container having a lid with a multipoint friction lock for retaining the lid closed on the container body, the lock comprising a stacking tab projecting from the perimeter of the body opening having undercut side edges and an aperture facing toward such opening while the lid has a notch located for the stacking tab to engage therein when the lid is closed, the ends of such notch being spaced to engage beneath the undercut side edges of the stacking tab and the notch providing a locking portion intermediate such notch ends to engage in the stacking tab aperture in the closed position of the lid. Preferably, the material of the lid is of semi-rigid character, such as corrugated paperboard, with the lid being diagonally scored to facilitate bending the lid for interengagement of the stacking tab and notch and accommodation of moderate over filling of the container by reason of such lid bending.

BRIEF DESCRIPTION OF THE DRAWINGS

The novel features of this invention are particularly recited in the appended claims, but the invention will be understood more fully and clearly from the following detailed description of the invention given with reference to the accompanying drawings in which:

DESCRIPTION OF THE INVENTION

Figure 1:
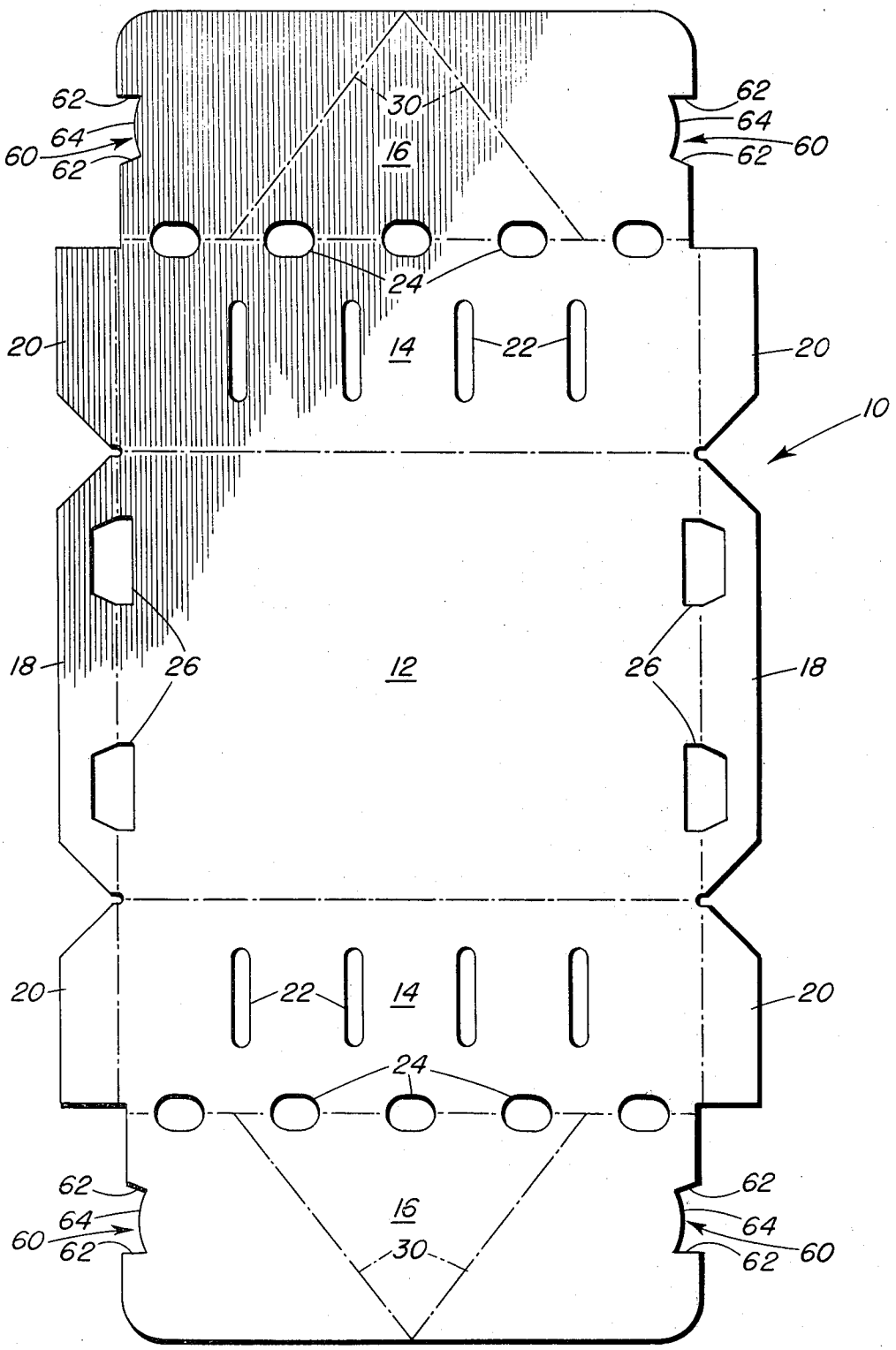
FIG. 1 is a plan view of a foldable container blank prior to its folding and assembly.

As described below and contemplated in the drawing illustrations, the container of the invention is preferably constructed of a semi-rigid material such as cardboard or corrugated paperboard. The container is particularly well suited to packing and shipping fruit and vegetable produce such as fresh table grapes. However, it is to be understood that the container of this invention may be fabricated of any other suitable material and also may be used for the shipment or storage of any objects or materials.

Figure 2:
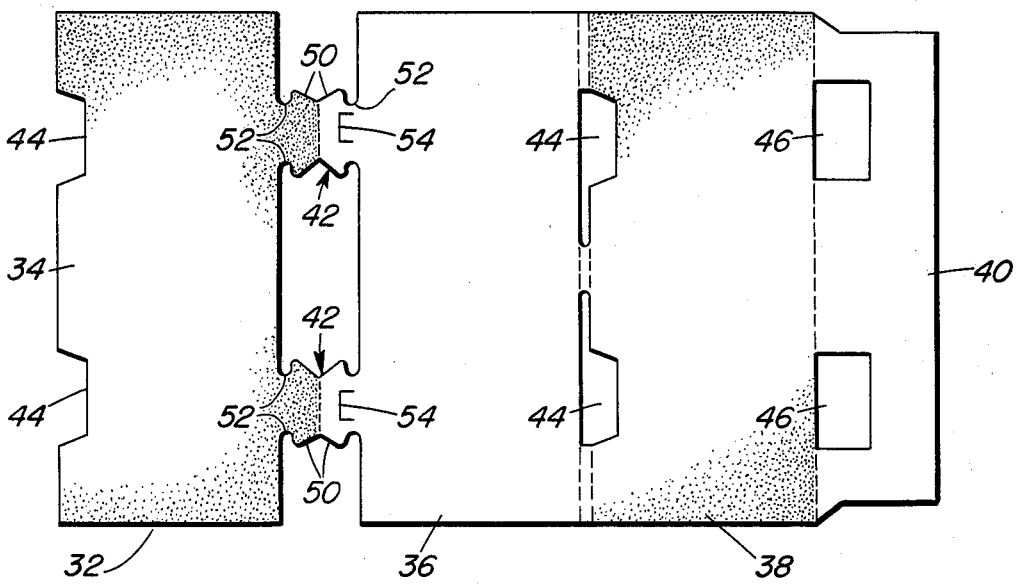
FIG. 2 is a plan view of an end wall blank of the container prior to its folding and assembly.
Figure 3:
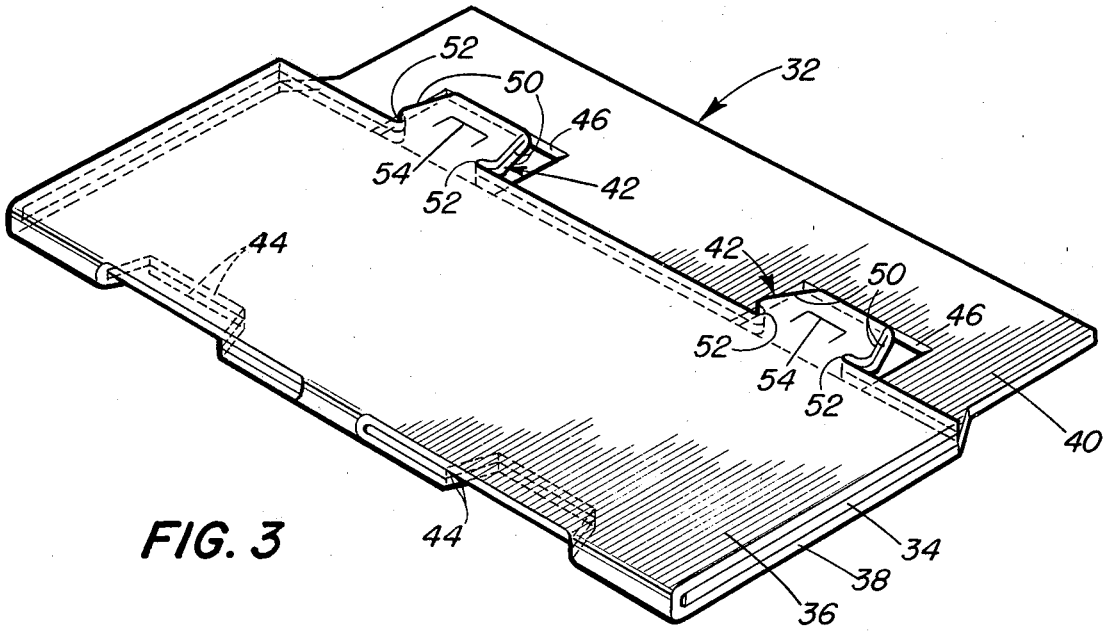
FIG. 3 is a perspective view of the end wall blank of FIG. 2 in its fully folded configuration.

On the drawings, FIG. 1 illustrates a foldable cardboard blank in its flat unfolded configuration. When folded it forms the sides, bottom and pair of closure flaps forming the lid of the complete container. FIG. 2 illustrates an end wall blank for the container in its flat unfolded configuration while FIG. 3 shows this blank folded into a completed end wall for the container. Two of the end wall blanks, fully folded as shown in FIG. 3, are joined with a single folded blank of the FIG. 1 configuration to form a complete container in accordance with this invention.

Referring to FIG. 1, container blank 10 comprises a bottom panel 12, side walls 14 and a pair of closure flaps 16 hingedly connected to the side walls 14, these closure flaps together forming the lid in the final completed container. End wall tabs 18 extend along the opposite ends of container bottom panel 12 and end wall tabs 20 are provided extending along the opposite ends of side walls 14. The container blank 10 is provided with appropriate ventilation holes such as indicated by the slots 22 shown provided in side walls 14. Generally oval holes 24 may be formed in blank 10 spaced along the hinge connection for each closure flap 16 to its adjoining side wall 14. Finally, the container blank 10, as shown in FIG. 1, has four clearance holes 26 provided in pairs at the opposite ends of the bottom panel 12 spaced along the fold line between panel 12 and each end wall tab 18. As will become more apparent, the clearance holes 26 fold to form a portion of the stacking recesses for the container but the functions of all abovementioned elements are described in detail herein below. However, it may be noted that the dot-dash lines appearing on FIG. 1 and elsewhere on the drawings are intended to represent score or fold lines along which the separate panels or elements making up the container body blank 10 are folded relative to one another to form the container body.

Specific note may be made with reference to diagonal score lines 30 that are provided on each of the closure flaps 16 making up the container lid, these lines being best illustrated on the container blank 10 as shown in FIG. 1. These diagonal score lines 30 serve two functions. First, they allow the individual closure flaps 16 to be individually bent to a limited extent along the controlled bend lines defined by the score lines 30 to facilitate interengagement between the elements making up the multipoint friction lock of this invention for retaining the lid closed on the container body. As will become apparent from the description hereinafter, these elements are provided by the particular configuration and engagement of a stacking tab carried by the container body cooperating with a locking notch formed on an edge of the container lid which in the disclosed embodiment is provided by the pair of closure flaps 16.

A second function of the diagonal score lines 30 provided on the closure flaps 16 is to provide effective control of a bulge in the lid of the container which may be caused by over packing. For example, when an excess quantity of grapes or like produce are placed in the container, the closure flaps 16 of the lid may undergo controlled bending along the diagonal score lines 30 allowing the flaps to form a space for the excess. This controlled bending of the lid flaps 16 along score lines 30 also helps to keep the multipoint friction lock which retains the lid closed on the container body in place and effective with the several stacking tabs and locking notches interengaged as described below.

Referring to FIGS. 2 and 3, the end wall blank 32 comprises a center panel 34, an inner panel 36, an outer panel 38 and a ledge flap 40. Each of these panels and ledge flap are foldable relative to one another along the fold or score lines indicated on FIG. 2 into the fully folded end wall configuration as shown on FIG. 3. Center panel 34 and inner panel 36 are formed with adjoining central cutouts so that these two panels remain connected solely by the portions that when folded form the stacking tabs 42. The folded condition of stacking taps 42 is shown on FIG. 3 where the center and inner panels 34 and 36 have been folded together.

The center panel 34 and outer panel 38 also have cutouts 44 which overlie one another when these panels are folded together so that these overlying cutouts 44 form stacking recesses in the lower edge of the end wall of the container when fully assembled. Cutouts 46 are formed in ledge flap 40 to provide a clearance space for the passage of the stacking tabs 42 when the container is assembled.

It may be noted that the stippled areas shown on FIG. 2 represent surfaces to which adhesive will be applied prior to folding the end wall blank 32 into its assembled configuration as shown in FIG. 3. When so assembled, center panel 34 becomes sandwiched in between inner panel 36 and outer panel 38, with notches 44 overlying each other to form the stacking recesses for the container along what will be the bottom edge of the container end wall as best shown on FIG. 3.

Figure 4:
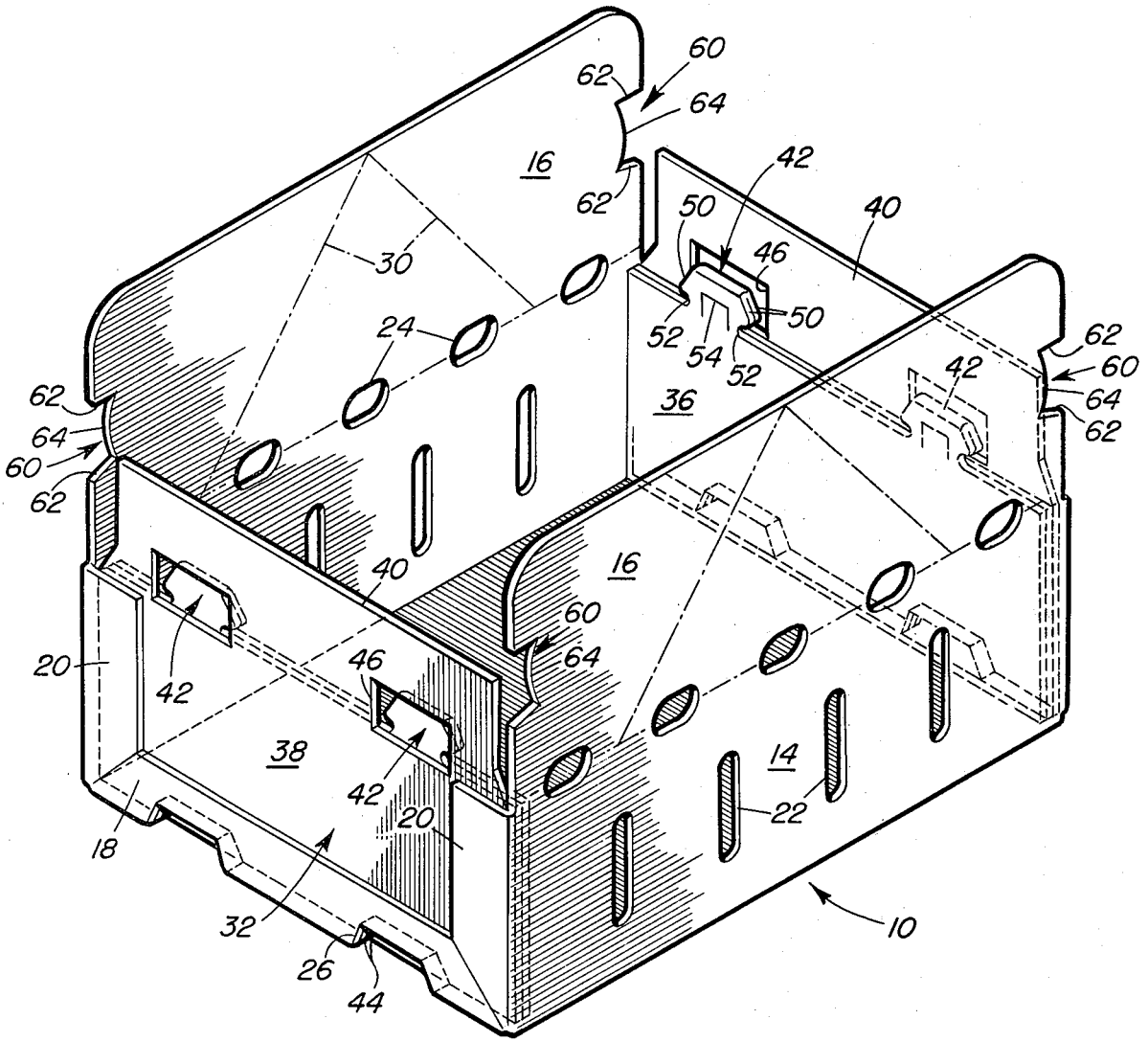
FIG. 4 is a perspective view of the assembled container showing the pair of closure flaps making up the lid in an open position.

Referring to FIG. 4 showing the completely assembled container, two end wall blanks 32 have been folded and glued to form completed end walls which are then glued in position to container blank 10 which also has been appropriately folded, these two end walls 32 being glued along the mating surfaces of end wall tabs 18 and 20 provided on bottom panel 12 and side walls 14, respectively, of container blank 10. In FIG. 4, the lid closure flaps 16 remain in their upstanding unfolded condition relative to the container body at the perimeter of the body opening. Likewise, the ledge flaps 40 carried at the upper ends of the container end walls 32 remain upstanding and unfolded as shown on FIG. 4. In closing the container the ledge flaps 40 are folded inward along the top edges of the end walls 32 at the perimeter of the body opening with cutouts 46 in the ledge flaps 40 clearing the upstanding stacking tabs 42 when the ledge flaps 40 are folded over. Then the closure flaps 16 forming the lid for the container are folded over whereupon the multipoint friction lock which retains the lid closed on the container body becomes effective to hold the container in its fully closed condition as shown on FIG. 5.

The multipoint friction lock is formed by interengagement of each stacking tab 42 with a mating and cooperating locking notch formed on the edge of the lid provided by the closure flaps 16 in the embodiment illustrated on the drawings.

Figure 5:
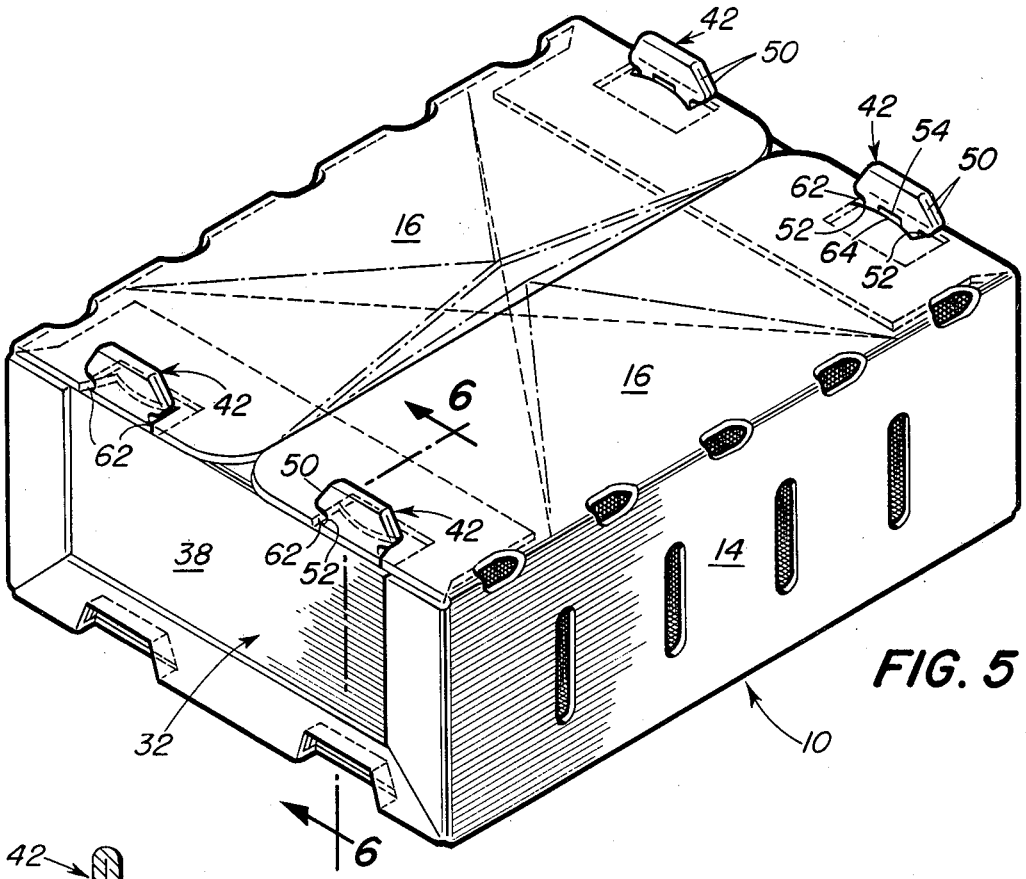
FIG. 5 is a perspective view of the assembled container of FIG. 4 but showing the closure flaps of the lid in their closed and locked position.

The configuration of the stacking tabs 42 provided on each container end wall 32 may be best seen from the flat end wall blank shown on FIG. 2. FIGS. 4 and 5 show the fully folded condition of the stacking tabs 42 and illustrate how the configuration of the stacking tabs enters into the multipoint friction lock for retaining the container lid closed.

Figure 6:
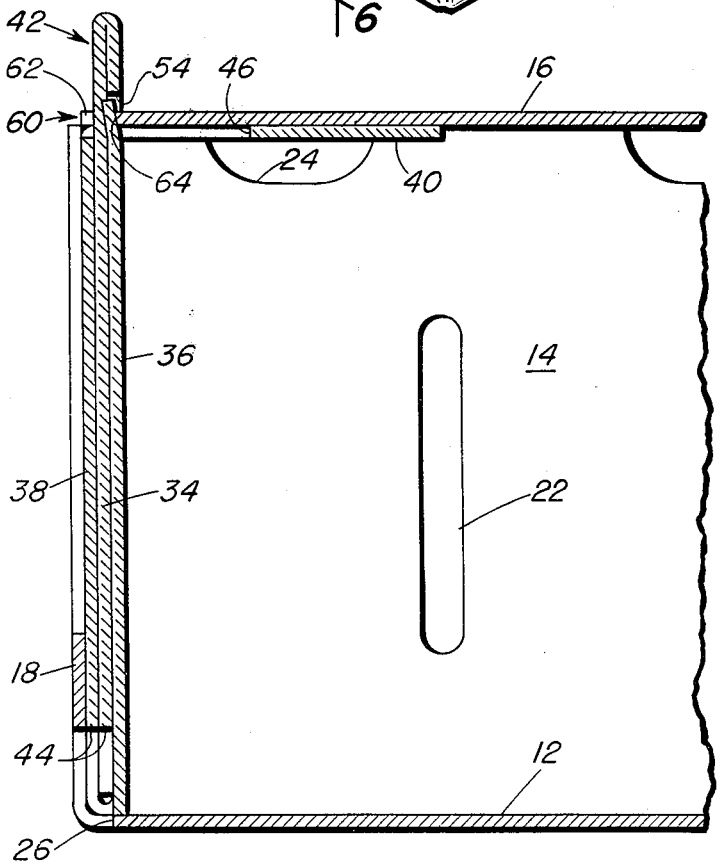
FIG. 6 is a partial sectional view taken on line 6—6 of FIG. 5.

Each stacking tab 42 projects from the perimeter of the container body opening as shown on FIGS. 4, 5 and 6. In the illustrated embodiment both side edges 50 of the stacking tab 42 are undercut to form a recess 52 on each edge 50, such recess lying adjacent the base of the stacking tab 42. When the center panel 34 and inner panel 36 are folded into the completed end wall shown on FIG. 3, these side edges 50 of stacking tab 42 as well as the recesses 52 on these edges lie parallel to form the completed stacking tab shown on the end wall 32 in FIG. 3 and in the assembled containers shown on FIGS. 4 and 5.

Further, each stacking tab 42 has an aperture 54 formed on the inner face of the tab. As best shown in FIGS. 2, 3 and 6, this inner face is part of the inner panel 36 and when the end wall panels 32 are assembled into the container this aperture 54 on each stacking tab 42 faces toward the opening of the container body. Preferably, this aperture 54 on the face of each tab 42 is formed in the tab face by a cut made in the face which defines a segment on this face. Where the container is constructed of a semi-rigid material, such as corrugated paperboard, this segment of the face defined within the cut may easily be depressed to create a positive shoulder or ledge for the hereinafter described locking tab portion on the container lid notch to engage within. The cut defining the segment to form aperture 54 is simply shown on FIGS. 2 and 3 as provided by three cut lines, two being perpendicular to the ends of a cut line extending longitudinally along a portion of the width of tab 42 on the face of the tab provided by the inner end wall panel 36. It will be understood that the cut defining a segment on the face of the tab 42 could take a variety of different forms as desired to provide the stacking tab aperture 54.

A second element forming the multipoint friction lock for retaining the lid closed on the container body which cooperates with the stacking tab 42 is provided by a locking notch 60 formed on an edge of the lid which closes the container opening. In the illustrated embodiment, this lid is provided by the closure flaps 16 with each such closure flap having both ends formed with a locking notch 60 that is located along the flap end edge to cooperate and interengage with a stacking tab 42 on the container body opening perimeter. As shown more clearly on FIGS. 4 and 5, this illustrated embodiment gives four multipoint friction locks, two for each closure flap 16 of the container lid.

The particular configuration of the locking notches 60 may best be seen by viewing the flat container blanks 10 in its unfolded condition as shown on FIG. 1. As shown thereon, each closure flap 16 at the top and bottom of FIG. 1 has a locking notch 60 formed in both ends thereof. It will be appreciated that for these locking notches to properly cooperate and interengage with the stacking tabs 42 carried by the container body, they must be and are located along the edge of the closure flap 16 for the appropriate stacking tab 42 to engage therein when the lid created by closure flap 16 is closed on the container body.

Each locking notch 60 has ends 62 which are spaced apart relative to the undercut side edges 50 of the stacking tab 42 with which the notch will interengage for these ends 62 of notch 60 to engage in the recesses 52 of the stacking tab 42 when the lid is closed. With reference to the ends 62 of each locking notch 60, it will be noted, again as best seen on FIG. 1, that each outer end of each notch 60 on a closure flap 16 is cut to extend generally parallel to the length of the particular closure flap while each inner end 62 of each notch 60 on a closure flap 16 is inclined outwardly to give the notch a wider opening at the flap end edge.

Each locking notch 60 is further formed with a locking portion 64 which protrudes into or inwardly of the notch intermediate the notch ends 62. This locking portion 64 is defined by an arcuately curved length of the bottom edge of the notch intermediate the notch ends 62. As specifically illustrated, the locking portion 64 is defined by a segment of a circle but obviously it may be given any desired configuration for the portion 64 of each notch 60 to perform its function of lockingly engaging in the aperture 54 of the stacking tab 42 with which the particular locking notch cooperates and interengages to retain the lid closed on the container body.

Having described the salient features of the multipoint friction lock, four of which are shown on the illustrated embodiment for retaining the lid closure flaps 16 closed on the container body, a summarized description of the effective functioning of each such multipoint lock may now be given. As closure flap 16 is folded down toward its final position inclosing the container as shown on FIG. 5, the locking notches 60 at the ends of the flap pass down over the truncated ends of the stacking tabs 42 on container end walls 32. The ends 62 of these notches 60 are spaced apart such that in the final position of the lid closure flap 16 the notch ends 62 will engage in or lie within the recesses 52 that are disposed in the undercut side edges adjacent the base of the stacking tab. At the same time, the locking portion 64 of each locking notch 60 will engage in the aperture 54 of the stacking tab 42, this relationship of locking portion 64 and aperture 54 on a stacking tab 42 being best shown on FIG. 6.

Thus a three point friction lock between each cooperating pair of stacking tab 42 and a locking notch 60, both formed with the characteristics hereinabove described, serves to retain the lid closed on the container body. As obvious, four such locks for the container lid are illustrated on the embodiment of the drawings.

Reference should also be made in connection with the closing operation for the lid closure flaps 16 to the diagonal score lines 30 provided on each flap 16. These score lines 30 allow each closure flap 16 to be bent slightly to facilitate or enable the notches 60 on the ends of the closure flap 16 to slide on and into proper interengagement with the stacking tabs 42. Not only will this facilitate the notch ends 62 moving easily and firmly into the recesses 52 at the undercut side edges of the stacking tab 42, but also it promotes effective movement of the locking portion 64 of notch 60 in the aperture 54 on the face of tab 42 that faces toward the container opening.

Utilizing the multipoint friction lock associated with a container and its lid together with the other features hereinabove described, secure locking of the lid on the container body can be achieved. Indeed repeated openings and reclosings with effective locking are possible. A plurality of these containers can be stacked merely by placing one on top of the other with stacking tabs 42 engaging with stacking recesses 44 of superposed containers. The multipoint friction lock on each container will essentially be uneffected by any damage which might occur to the upwardly projecting stacking tabs 42 incident stacking and unstacking of multiple containers.

It will be obvious to one of ordinary skill in the art that numerous modifications and changes may be made without departing from the true spirit and scope of the invention which is to be limited only by the appended claims.

We claim:

1. A container suitable for produce and the like having a body defining the container opening and a lid to close such opening with a multipoint friction lock for retaining the lid closed on the container body, said lock comprising:

a stacking tab projecting from the perimeter of said body opening having at least one undercut side edge forming a recess at such edge adjacent the base of said tab, and said tab further having an aperture formed on the face of said tab facing toward said opening; and a locking notch formed on an edge of said lid located therealong for said stacking tab to engage therein when said lid is closed on said container body, said notch having at least one end thereof disposed relative to said undercut side edge of said stacking tab so as to engage in said recess of said stacking tab when said lid is closed, and said notch further having a locking portion protruding into said notch intermediate the notch ends to engage in said stacking tab aperture in the closed position of said lid, said lid is constructed of semi-rigid material and scored generally transversely to facilitate bending said lid for disengagement of said locking portion in said aperture when said lid is bent and engagement of said locking portion in said aperture when said lid is unbent.

2. A container as recited in claim 1 wherein both side edges of said stacking tab are undercut to form a recess at each edge adjacent the base of said tab, and said notch has the ends thereof spaced apart relative to the undercut side edges of said stacking tab for said ends to engage in the recesses of said stacking tab when said lid is closed.

3. A container as recited in any one of claims 1 or 2 wherein said lid is provided by a pair of closure flaps hingedly connected to the opposite sides of said container body, stacking tabs are provided on the perimeter of said body opening for both ends of each of said closure flaps, and each said closure flap has both ends thereof formed with one said locking notch that is located along the flap end edge to cooperate with a stacking tab on the body opening perimeter.

4. A container as recited in any one of claims 1 or 2 wherein said locking portion of said notch is defined by an arcuately curved length of the bottom edge of said notch intermediate the notch ends.

5. A container as recited in claim 4 wherein said stacking tab aperture is formed in the tab face by a cut defining a segment on said face which is depressible for said locking portion to engage therein.

* * * * *